US006375045B1

(12) United States Patent
Ki

(10) Patent No.: US 6,375,045 B1
(45) Date of Patent: Apr. 23, 2002

(54) AIRLESS TYPE DISPENSER

(75) Inventor: Jung Hyun Ki, Inchon (KR)

(73) Assignee: Yonwoo Corporation, Inchon (KR)

( * ) Notice: Subject to any disclaimer, the term of this patent is extended or adjusted under 35 U.S.C. 154(b) by 0 days.

(21) Appl. No.: 09/628,460

(22) Filed: Jul. 31, 2000

(30) Foreign Application Priority Data

Mar. 30, 2000 (KR) ..... 2000-9050

(51) Int. Cl.[7] ..... B67D 5/42

(52) U.S. Cl. ..... 222/386; 222/256; 222/320; 222/387

(58) Field of Search ..... 222/257, 256, 222/320, 385, 387, 386; 92/248, 249

(56) References Cited

U.S. PATENT DOCUMENTS 4,685,594 A * 8/1987 Czech ..... 222/182
5,104,004 A * 4/1992 von Schuckmann ..... 222/135
5,788,124 A * 8/1998 Bougamont et al. ..... 222/207

* cited by examiner

*Primary Examiner*—Kevin Shaver
*Assistant Examiner*—Stephanie L. Willatt
(74) *Attorney, Agent, or Firm*—Lahive & Cockfield, LLP

(57) ABSTRACT

The invention relates to an airless type dispenser. According to an aspect of the invention, there is provided with an airless type dispenser comprising a receptacle 11, a piston 18 inserted in the receptacle 11, a dispenser cap 12 which is coupled to the opening of the upper end of the receptacle 11 and includes a pump 14, a button 15 and a nozzle 16 wherein, on the upper surface of the piston 18, a material which has lower expansibility than the piston 18 is laminated.

1 Claim, 3 Drawing Sheets

(PRIOR ART)

AIRLESS TYPE DISPENSER

FIELD OF THE INVENTION

The invention relates to an airless type dispenser and more particularly to an airless type dispenser in which a problem like a chemical reaction between a cosmetic substance and the piston material can be prevented, and accordingly wrong operation can be avoided.

BACKGROUND OF THE INVENTION

There are two types of conventional dispensers wherein a predetermined quantity of cosmetics substance or the like is ejected by air pressure. One of which is a dip tube type wherein the substance is sucked and ejected by the dip tube and the corresponding quantity of air comes in, and the other of which is the airless type wherein a piston is ascended and the substance is pushed up according as the air comes in the receptacle evacuates. FIG. 1 shows the airless type dispenser of the prior art. As shown in FIG. 1, the upper end of the receptacle is covered with a dispenser cap 12. This dispenser cap 12 includes a pump 14, a button 15, and nozzle 16. And a piston 18 is provided in the receptacle 11 airtightly. Conventionally, the piston 18 was generally made with the polyethylene resin. The reason is that, if the piston is made of polyethylene resin, it has excellent flexibility, elasticity and lubrication, and accordingly, airtightness between the piston and the inner wall of the receptacle can be secured. In addition, the piston can be readily slidable along the inner wall.

Also, the prior art polyethylene piston 18 can cause some troubles if it reacts with a pigment dispersant which may be included as a cosmetic substance. In that case, many kinds of critical defects may be resulted. One of these defects is the piston 18 may not slide along the inner wall of the receptacle 11 because the pigment dispersant which may be for foundation or makeup base is absorbed into the polyethylene piston 18 and causes swelling of the piston 18, or the airtightness may be destroyed owing to irregular swelling. As stated above, because the polyethylene piston has high expansibility it can easily absorb cosmetic substances that contain pigment dispersant, thus, causing swelling of the piston 18 which causes defects to dispenser products.

SUMMARY OF THE INVENTION

The present invention solves the above described problems by providing an airless type dispenser that can prevent chemical reactions between cosmetic substances and the piston material.

According to an aspect of the invention, an airless dispenser is provided. The airless dispenser comprises a receptacle 11, a piston 18 inserted in the receptacle 11, a dispenser cap 12 which is coupled to the opening of the upper end of the receptacle 11 and includes a pump, a button and a nozzle, wherein on the upper surface of piston 18 is laminated with a material which has a lower expansibility than the piston.

DETAILED DESCRIPTION OF THE INVENTION

A preferred embodiment of the invention will be described in detail below by referring to the accompanying drawings.

Figure 1:
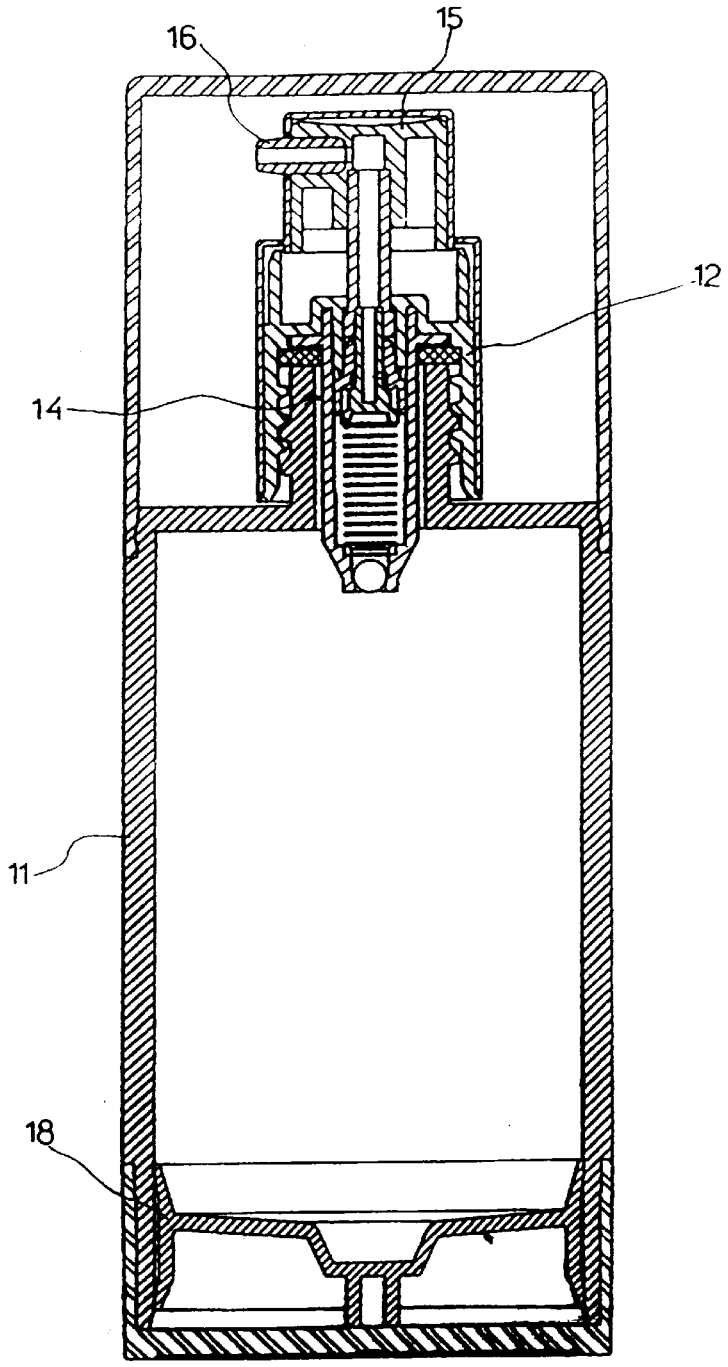
FIG. 1 shows a cross-sectional view of a prior dispenser.
Figure 2:
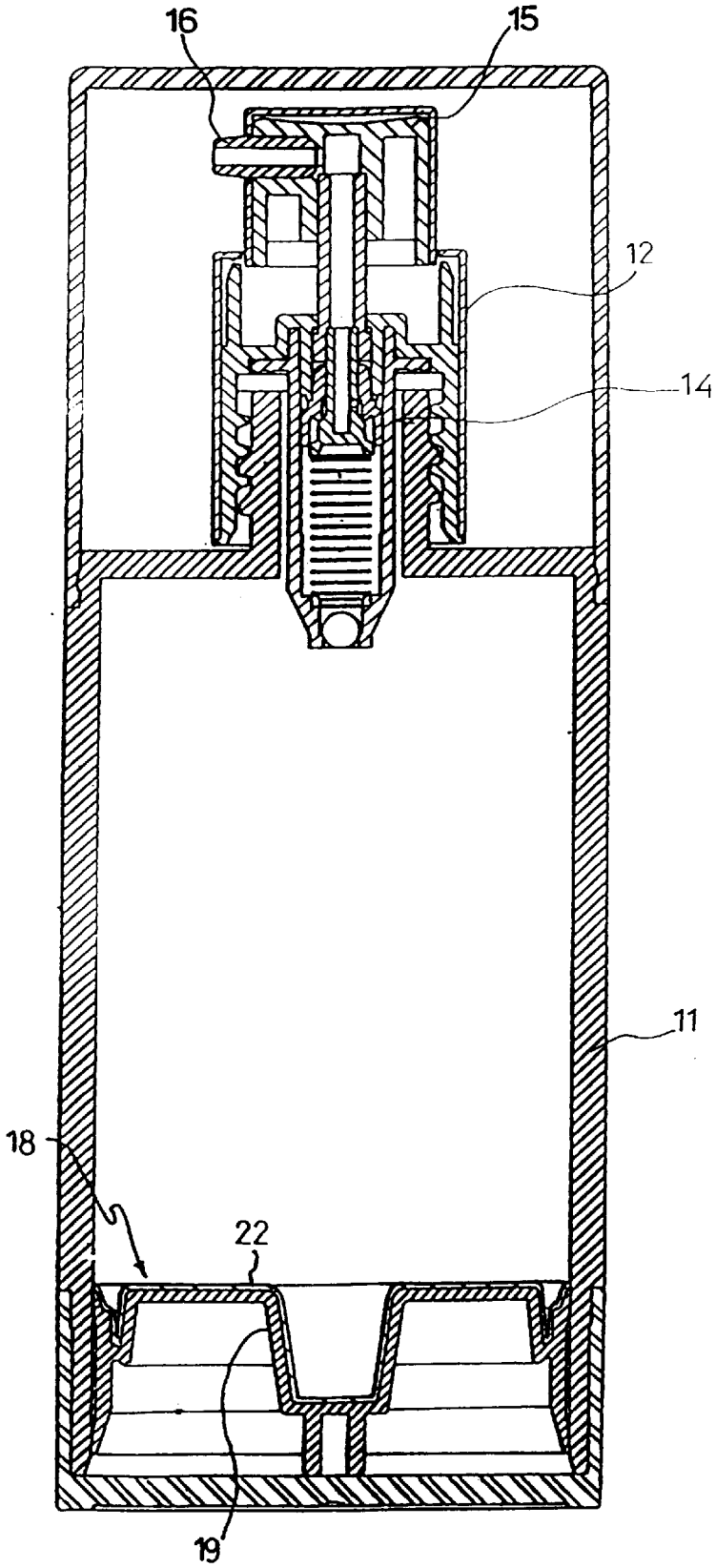
FIG. 2 shows a cross-sectional view of a dispenser according to a preferred embodiment of the invention.
Figure 3:
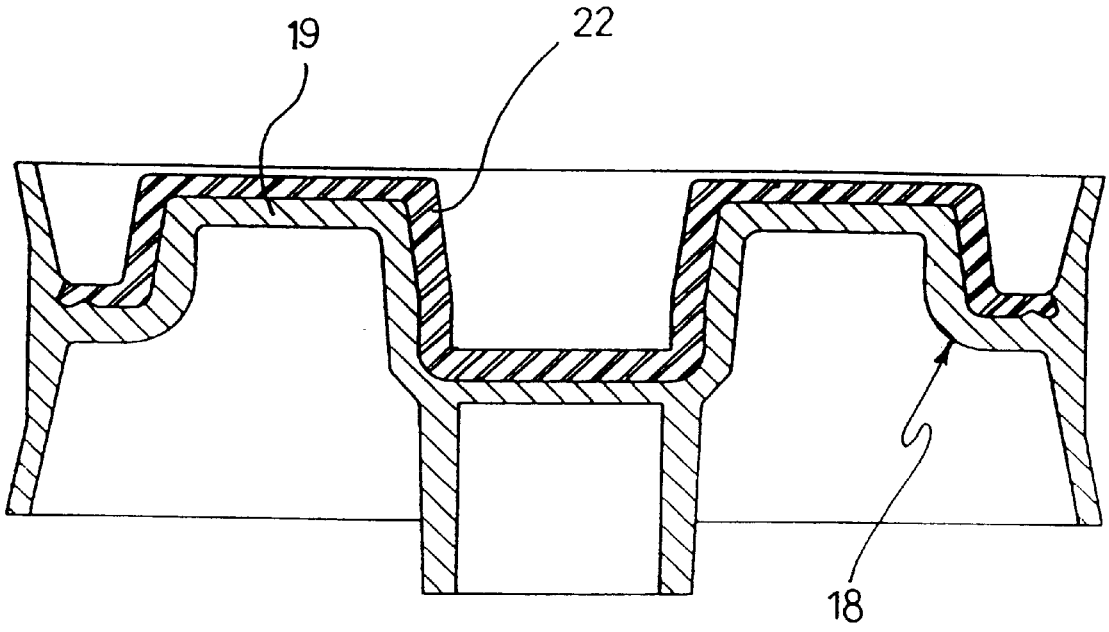
FIG. 3 shows a enlarged cross-sectional view of the piston.

FIG. 2 and FIG. 3 show respectively a perspective view and a major part of an enlarged cross-sectional view of a preferred embodiment of the invention.

As shown in FIGS. 2 and 3, a dispenser cap 12 s coupled to the opening of the upper end of receptacle 11, and the dispenser cap 12 comprises a pump 14, a button 15 and nozzle 16, and a piston 18 is provided in the receptacle 11 slidably.

Here, an upper layer 22 is laminated on the surface of the piston 18 by laminating the upper surface of the piston body 19 with a material whose expansibility is lower than that of the piston body 19. Preferably, the piston 19 may be molded with polyethylene having excellent airtightness and lubrication, and the upper layer 22 may be made of polyprophylene, acrylonitrile-styrene resin or PET, PETG or PCTG etc. in the group of saturated polyestere. Airtightness or lubrication of these resins is relatively lower than that of polyethylene resin, however, the quality is more stable because the reactivity with pigment dispersants are low.

As the above, in forming the upper layer 22 on the surface of the piston body 19, different materials may be moulded into one body by double indjection moulding, insert moulding or the other proper methods.

Therefore, according to the invention, airtightness between the piston 18 and the inner wall of receptacle 11 can be secured because the piston body 19 has been formed with polyethylene which is excellent in airtightness and lubrication, furthermore, swelling or other troubles may be avoided because the upper layer 22 having low expansibility is formed on the upper surface of the body 19 which contacts directly to the substance of the cosmetic in the receptacle 11.

As described above, the upper layer 22 whose expansibility differs from the upper surface of the piston 18, the piston 18 may perform its operation smoothly without the possible occurrence of swelling. Thus, the illustrative embodiment prevents the swelling phenomena associated with dispenser products.

What is claimed is:

1. An airless type dispenser comprising:

a receptacle for containing a substance within and includes an opening on the upper end of the receptacle;

a piston inserted in the receptacle; and a dispenser cap which is coupled to the opening of the upper end of the receptacle and includes a pump, a nozzle, and a button, wherein the upper surface of said piston is laminated with a material which has a lower expansibility than said piston.

* * * * *